United States Patent [19]

Powers

[11] Patent Number: 4,984,366

[45] Date of Patent: Jan. 15, 1991

[54] ELASTOMERIC RECEPTACLE FOR NAIL CLIPPER

[76] Inventor: Robert B. Powers, 1244 Tucson Ave., Sunnyvale, Calif. 94089

[21] Appl. No.: 474,696

[22] Filed: Feb. 6, 1990

Related U.S. Application Data

[63] Continuation of Ser. No. 264,282, Oct. 28, 1988, abandoned.

[51] Int. Cl.[5] ..... A45D 29/00

[52] U.S. Cl. ..... 30/124; 30/28; 132/75

[58] Field of Search ..... 30/28, 124; 132/75, 132/73, 73.5

[56] References Cited

U.S. PATENT DOCUMENTS

| | | | |
|---|---|---|---|
| 2,753,626 | 4/1955 | Bowers . | |
| 2,887,773 | 6/1957 | Killen . | |
| 3,188,737 | 2/1964 | Chase . | |
| 3,855,698 | 12/1974 | Crosby . | |
| 4,130,937 | 12/1978 | Kim . | |
| 4,341,015 | 7/1982 | Young | 30/78 |
| 4,550,496 | 11/1985 | Reinicke . | |
| 4,602,430 | 7/1986 | Allen, Jr. . | |
| 4,640,011 | 2/1987 | Gamble . | |

*Primary Examiner*—Hien H. Phan
*Assistant Examiner*—Willmon Fridie, Jr.
*Attorney, Agent, or Firm*—Skjerven, Morrill, MacPherson, Franklin & Friel

[57] ABSTRACT

A nail clipper receptacle for use with any standard spring type nail clipper wherein said receptacle is an elastomeric sheath of a conical shape having an opening at one end for receiving a standard nail clipper and an opening proximate to the first opening for allowing a lever of the nail clipper to extend through, whereby the elastomeric sheath surrounds the nail clipper and ensures nail clippings are retained within the nail clipper structure.

10 Claims, 1 Drawing Sheet

ELASTOMERIC RECEPTACLE FOR NAIL CLIPPER

This application is a continuation of application Ser. No. 07/264,282, filed Oct. 28, 1988 now abandoned.

FIELD OF THE INVENTION

This invention relates to nail clippers, such as fingernail clippers and toenail clippers, of the type in which resiliently secured blades are brought together by a lever means, and relates in particular to a receptacle for nails cut by these types of nail clippers.

BACKGROUND OF THE INVENTION

It is desirable when cutting nails with the standard type of nail clippers, incorporating resiliently secured blades operated by a pivoted lever, to have the clipped nails be easily collected and disposed of. Various types of prior art nail receptacles for use with these types of nail clippers have been shown in U.S. Pat. Nos. 2,753,626; 2,887,773; 3,188,737; 3,855,698; 4,130,937; 4,341,015; 4,550,496; 4,602,430; and 4,640,011. In all of these prior art patents a plastic or otherwise semi-rigid receptacle is provided which is designed for use with a particular model of nail clipper and, hence, may not necessarily be used with more than one model of nail clipper. As is well known, there are numerous models of nail clippers. Further, many of these prior art nail receptacles require concurrent fabrication with the nail clipper and, hence, may not be bought separately from the nail clipper. At present, if a consumer desired the convenience of a nail clipper receptacle, the consumer would have to purchase the receptacle along with its corresponding nail clipper. Since most consumers already possess a nail clipper, this would mean a purchase of a redundant nail clipper just for obtaining the convenience of the receptacle.

It would be extremely desirable to provide an inexpensive nail clipper receptacle which may adapt to fit all types of standard nail clippers now on the market so that the convenience of a nail receptacle may be obtained without requiring the purchase of a particular model of nail clipper.

SUMMARY OF THE INVENTION

The invention is an elastomeric conically shaped nail receptacle which has an opening at one or both ends and which is merely slid over a standard nail clipper in a way so that the lever means of the nail clipper is unimpeded by the elastomeric nail receptacle. The resiliency of the elastomeric nail receptacle enables the nail clipper to be operated in its usual manner without impedance and enables the elastomeric nail receptacle to be extended to fit over the full range of sizes of standard nail clippers. The elastomeric nail receptacle substantially encases the nail clipper so that any cut nails are retained within the boundaries of the nail clipper and elastomeric nail receptacle. To empty nails contained within the nail clipper, the nail receptacle is merely slid completely or part way off the nail clipper and the nail clippings are conveniently disposed of in a waste receptacle.

DETAILED DESCRIPTION OF THE INVENTION

Figure 1:
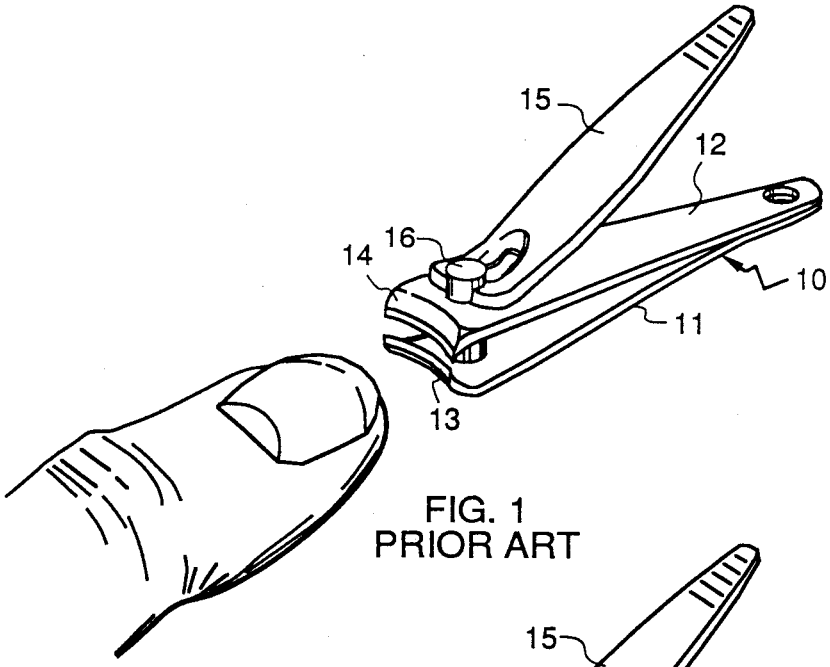
FIG. 1 PRIOR ART
FIG. 1 is a perspective view of a standard spring type nail clipper with its lever means in position to cut a finger nail.

FIG. 1 shows nail clipper 10 of the usual form and construction, having a pair of elongated spring arms or jaw members 11 and 12 which are rigidly secured together at one end and which diverge at their other end. Spring arms 11 and 12 are pressed together in opposition to their inherent resilient force by a downward pressure on lever 15. Upon downward pressure applied by lever 15, cutting edges 13 and 14 cooperatively engage to clip the nail. Preferably, cutting edges 13 and 14 are accurately curved to facilitate cutting of the curved nail edge. Lever 15 is pivoted at one end to pin 16 extending through aligned openings formed in spring arms 11 and 12 and is rotatably mounted so that lever 15 may be turned 180° and put in its stored position for compactness.

Figure 2:
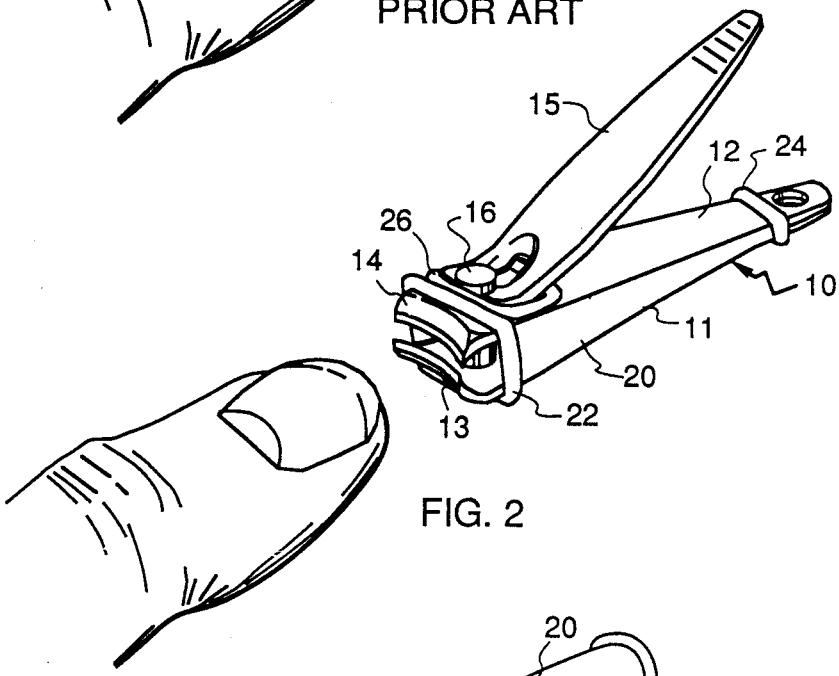
FIG. 2 is a perspective view of the nail clipper of FIG. 1 with my inventive elastomeric nail receptacle surrounding the nail clipper.

FIG. 2 shows elastomeric nail receptacle 20 stretched over the body of nail clipper 10 of FIG. 1 and resiliently held in position by pin 16 at one end and held in position at the other end by friction created between conically shaped elastomeric nail receptacle 20 and the tapered body of nail clipper 10. Thus, when nails are clipped they are retained within the boundaries provided by nail clipper 10 and elastomeric nail receptacle 20. When nails are to be disposed of, narrow end 24 of nail receptacle 20 is merely pulled or rolled back towards the cutting end of nail clipper 10 so that the nail clippings may be dumped out from between spring arms 11 and 12 into a waste receptacle. Nail receptacle ends 22 and 24 are reinforced to prevent tearing as is opening 26 through which lever means 15 and pin 16 extend.

Figure 3:
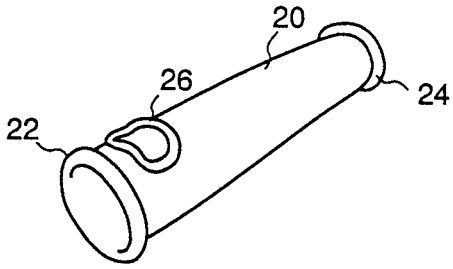
FIG. 3 is a side view of my inventive elastomeric nail receptacle.

Shown in FIG. 3 is elastomeric nail receptacle 20 by itself. Clearly shown is the conical shape of nail receptacle 20 along with reinforced ends 22 and 24 and reinforced opening 26. In one embodiment, nail receptacle 20 is of a latex material which is easily stretched, highly resilient, and relatively resistant to tearing or puncturing. In a preferred embodiment, nail receptacle 20 of FIG. 3 is approximately 2.5 inches long so as to be slightly extended when placed on a common type nail clipper of small dimensions, and wide end 22 has an opening with a circumference of approximately 1.25 inches to provide the necessary snug fitting on the smallest, yet most frequently used, fingernail type clipper. Narrow end 24 is designed to have an opening with a circumference of approximately 0.75 inches to provide the necessary high friction contact between nail receptacle 20 at narrow end 24 and a nail clipper of the smallest dimension. The opening at narrow end 24 also allows a file, frequently pivotably secured to a rivet at the narrow end of a nail clipper, to be swung into its open position by rolling narrow end 24 of nail receptacle 20 toward the cutting end of the nail clipper to reveal the file. Opening 26 is of an oval shape with a major axis dimension, perpendicular to the lengthwise dimension of nail receptacle 20, of approximately 0.5 inches and a minor axis dimension of approximately 0.37 inches so as to easily stretch over lever 15 and to allow the base of level 15 to directly contact the nail clipper and pivot without pinching or tearing nail receptacle 20.

All dimensions specified herein may be modified as desired to provide the desired snugness of nail receptacle 20 around a standard nail clipper. The resiliency of the material which forms nail receptacle 20 should be sufficient to enable nail receptacle 20 to stretch over all standard sizes of nail clippers including the larger toenail clippers. If a thicker, more wear resistant latex material is desired, the ability to stretch nail receptacle 20 over a larger type toenail clipper may not be feasible and a nail receptacle similar to that of nail receptacle 20 may be easily designed with larger dimensions for the toenail type nail clippers.

Thus, an inexpensive nail receptacle has been shown which may be sold separately from the nail clipper and which may fit on any standard type nail clipper.

While this invention has been described in detail with particular reference to a preferred embodiment thereof, it will be understood that variations and modifications can be made without departing from the spirit and scope of the invention as defined in the appended claims.

I claim:

1. A nail clipper receptacle for use with a standard nail clipper of the type including a pair of spring jaws fixed together at a narrow first end, diverging at a second end, and having cutting edges formed at said second end for cooperating to oppose one another when a lever is operated to overcome inherent resiliency of said spring jaws and cut a nail, said nail clipper receptacle comprising:

an elastomeric sheath of a conical shape formed of a highly resilient material, said sheath having a wide end and a narrow end, said sheath having a first opening at said wide end so that, when said sheath is fitted over a standard nail clipper, cutting edges of said nail clipper protrude through said first opening of said sheath, said highly resilient material allowing said sheath to be stretched over said standard nail clipper so as to generally conform to outer dimensions of said nail clipper and retain nail clippings within boundaries provided by said nail clipper and said nail clipper receptacle.

2. The nail clipper receptacle of claim 1 further comprising a second opening located proximate to said first opening for allowing a lever of said nail clipper to extend through.

3. The nail clipper receptacle of claim 2 further comprising a third opening in said narrow end of said elastomeric sheath.

4. The nail clipper receptacle of claim 3 where surrounding said first, second and third openings is a reinforced portion to prevent tearing of said elastomeric sheath.

5. The nail clipper receptacle of claim 4 wherein the length between said wide end and said narrow end is between 1.5 and 2.5 inches.

6. The nail clipper receptacle of claim 5 wherein the circumference of said first opening is between 0.8 and 1.5 inches.

7. The nail clipper receptacle of claim 6 wherein the circumference of said second opening is between 0.5 and 1.5 inches.

8. The nail clipper receptacle of claim 7 wherein said second opening is oval shaped with a major axis of said second opening being perpendicular to a lengthwise dimension of said nail clipper receptacle.

9. The nail clipper receptacle of claim 7 wherein the circumference of said third opening is between 0.3 and 1.0 inches.

10. The nail clipper receptacle of claim 1 wherein said elastomeric sheath is formed of a latex material.

* * * * *